US008657004B2

(12) United States Patent
Zhou

(10) Patent No.: US 8,657,004 B2
(45) Date of Patent: Feb. 25, 2014

(54) SLIDING STAGE CEMENTING TOOL

(75) Inventor: Shaohua Zhou, Dhahran (SA)

(73) Assignee: Saudi Arabian Oil Company (SA)

( * ) Notice: Subject to any disclaimer, the term of this patent is extended or adjusted under 35 U.S.C. 154(b) by 412 days.

(21) Appl. No.: 13/069,025

(22) Filed: Mar. 22, 2011

(65) Prior Publication Data

US 2012/0241154 A1 Sep. 27, 2012

(51) Int. Cl.
*E21B 33/13* (2006.01)

(52) U.S. Cl.
USPC ..... 166/289; 166/290; 166/177.4; 166/334.4; 166/122; 166/187

(58) Field of Classification Search
USPC ..... 166/289, 290, 291, 177.4, 332.1, 334.1, 166/334.4, 122, 187
See application file for complete search history.

(56) References Cited

U.S. PATENT DOCUMENTS

| | | | | |
|---|---|---|---|---|
| 2,155,609 | A | 1/1937 | McClendon et al. | |
| 3,948,322 | A | 4/1976 | Baker | |
| 4,349,071 | A | 9/1982 | Fish | |
| 5,109,925 | A | 5/1992 | Stepp | |
| 5,738,171 | A | 4/1998 | Szarka | |
| 6,520,257 | B2 * | 2/2003 | Allamon et al. | 166/291 |

OTHER PUBLICATIONS

Partial Int'l Search Report dated Jul. 1, 2013; Int'l Application No. PCT/US2012/028994; Int'l Filing Date: Mar. 14, 2012.

* cited by examiner

*Primary Examiner* — Giovanna Wright
(74) *Attorney, Agent, or Firm* — Bracewell & Giuliani LLP; Constance Gall Rhebergen; Keith R. Derrington

(57) ABSTRACT

A downhole tool provided within a casing string for use in cement staging operations. The tool includes an inflatable packer that is integral to the body of the tool and ports in sides of the tool. The ports are selectively opened and closed for circulating cement from within the tool so that cement can flow between the casing string and a wellbore. The ports are actuated by sliding the casing string upward or downward within the wellbore. The packer can be pressure tested after being set to ensure its efficacy.

18 Claims, 7 Drawing Sheets

SLIDING STAGE CEMENTING TOOL

BACKGROUND OF THE INVENTION

1. Field of the Invention

The present invention relates to an apparatus for use while completing a subterranean hydrocarbon producing well. More specifically, the invention relates to an apparatus for the staging of cement between casing and a wellbore.

2. Description of the Related Art

When completing a subterranean well, casing is typically inserted into the wellbore and secured in place by injecting cement within the casing. The cement is then forced through a lower end of the casing and into an annulus between the casing and wellbore wall. A wiper plug is typically used for pushing the cement from the casing. A displacement fluid, such as water, or an appropriately weighted mud is pumped into the casing above the plug, the pressurized fluid serves as a motive force to urge the plug downward through the casing to extrude the cement from the casing outlet and back up into the annulus. However, as wells are increasingly being drilled deeper, the hydraulics for cementing the casing wellbore annulus in a substantially deep well makes the single stage cement injection process impracticable. Also, in some instances it is impossible to cement the entire well. For example, cement is not provided in portions of the well, where the well formation pressure is less than well hydrostatic pressure, or where the formation is too porous so high cement slurry pressure in the case induces formation breakdown, which leads to losses in the formation, as a result, no cement is present.

To overcome the problems of a single stage cement process, the casing string is cemented in sections, which is known as a staging process. Staging involves placing cement staging tools integral within the casing string; the staging tools allow cement to flow downward therethrough to a lower section of the casing string during primary or first stage cementing operations. When the portion of the casing string below the particular staging tool is cemented to the well, the staging tool selectively closes its bore and opens a side port to divert cement into the surrounding annulus where the cement can flow upwards in the annulus. The cement staging tools also are equipped with packers for sealing the annular area between the tool and wellbore. However, presently known tools experience failures such as failure to inflate the packer element, failure to open ports, failure to close ports, and disconnection of the tool from the casing string.

SUMMARY OF THE INVENTION

The present disclosure discloses an apparatus and method of cementing a wellbore. In one example method of cementing a downhole tool is provided that has an annular casing box section that can be connected to a casing string. The tool further includes an annular mandrel section attached to an end of the casing box section and a tubular body. An end of the mandrel slides into the body. The mandrel has an aperture formed in a side wall and the body has a port formed through its side wall. The method further includes integrating the tool with a casing string and inserting the string with tool in the wellbore. Cement is pushed through the casing string and tool, then the bore in the tool is sealed. The aperture and port are registered by lowering the casing string and cement is flowed through the registered port and aperture. Optionally, the port and aperture can be unregistered by further lowering the casing string. The tool can also include a bladder that circumscribes the body, the bladder can be inflated to form a pressure seal between the tool and casing. The pressure seal can be pressure tested without removing the tool. In an alternative embodiment, the tool includes a flow path between the bore and bladder and through the body. An optional sleeve can be included that slides along an inner wall of the body and selectively blocks flow from the tool bore to the flow path. Thus the bladder can be inflated by selectively sliding the sleeve and flowing fluid through the flow path The sleeve can be provided with a shoulder that projects radially inward, a plug can be landed onto the shoulder and pushed downward by pressurizing the bore above the plug to slide the sleeve to the position away from the flow path. In an alternative example, the casing string can be lowered to move the mandrel adjacent the flow path and seal the bore from the bladder.

An alternative method of cementing a wellbore is provided herein that includes integrating a tool within a casing string in a wellbore. The tool of this example has an axial bore through its length. The tool further includes an annular casing box section adapted for connection to the casing string with an annular mandrel section connected to an end opposite the casing string. The mandrel slides within a tubular body that is circumscribed by a bladder. A flow line passes through the body between the bladder and the bore. The method of this example embodiment includes cementing a portion of the casing string below the tool by flowing cement through the bore, and forcing the cement out a lower end of the casing string. The cement then flows back upward into an annulus between the casing string and wellbore. The bladder is inflated by directing pressurized fluid from the bore through the flow line and to an inner surface of the bladder. When inflated, the bladder forms a pressure seal between the tool and an outer casing string. The pressure seal is pressure tested with the tool in place. Optionally, inflating the bladder includes sealing the bore below where the flow line intersects the bore. In another alternative example, the tool can have a sleeve coaxially set in the bore that is a flow barrier between the bore and the flow line, the method can further include forming a seal in the bore by pushing the sleeve downward. One example step of pushing the sleeve includes landing a plug in the sleeve that has pressurized fluid on its upper surface and pushes the sleeve downward. This removes the flow barrier to the flow line, and allows fluid to flow into the flow line and inflate the bladder. Optionally, the mandrel can be moved farther downward to block flow between the bore and the flow line. In another alternative, the tool can be optionally equipped with an aperture in a side wall of the mandrel section and a port formed radially through a side wall of the tubular body. The method can optionally include lowering the mandrel within the body to register the port and aperture and flowing cement from the bore, through the aperture and the port.

Further disclosed is a downhole tool for use in a wellbore cementing staging operation. In an example embodiment the tool includes an annular casing box section adapted for connection to a casing string. Connected to a lower end of the casing box section is an annular mandrel section that is inserted into an end of a tubular body. Apertures are formed radially through a side wall of the mandrel section and ports are included that pass radially through a side wall of the tubular body. Thus moving the mandrel section with respect to the body can selectively register and unregistered the apertures with the ports. In an alternative embodiment, the tool can have an annular sliding sleeve coaxially within a bore axially formed through the tool and selectively slidable from a first position in the body to a second position in the body. Optionally included with the tool is a packer that circumscribes a portion of the body and a flow line extending through a side wall of the body between a location adjacent the sliding sleeve. When the sliding sleeve is moved from between the flow line and the bore, the flow line is exposed to the bore thereby providing fluid communication between the bore and an inner surface of the packer. Check valves may be included in the flow line. Alternatively, the tool can be equipped with anchors. In one optional embodiment a flange is provided on the end of the mandrel inserted within the body that reciprocates within an annular space in the body that is coaxial with the flange. Yet further optionally, a casing pin can be included on the end of the tool distal from the casing box section.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1A:
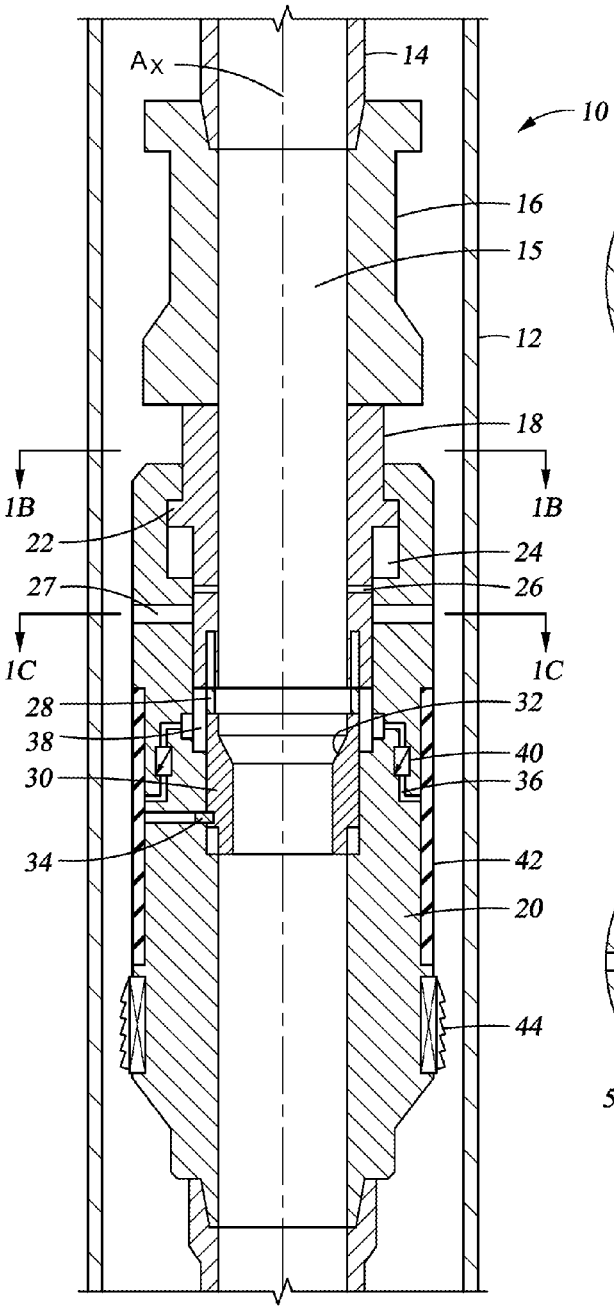
FIG. 1A is a side sectional view of an example of a stage cementing tool in accordance with the present disclosure.

An example embodiment of a sliding stage cementing tool 10 is shown in a side sectional view in FIG. 1A inserted within a string of outer casing 12. The cementing tool 10 is deployed integral within an inner casing string 14 shown connected to the cementing tool 10 with a threaded connection. An axial bore 15 extends through the tool 10 so that anything flowing through the casing string 14 thereby flows through the cementing tool 10. An annular casing box 16 is provided on an upper end of the cementing tool 10 and is where the casing string 14 attaches to the cementing tool 10. An optional flange is provided on an upper end of the casing box 16 that circumscribes the threaded connection between the cementing tool 10 and casing string 14. The lower end of the casing box 16 is provided with a shoulder that slopes radially outward from a reduced diameter portion of the casing box 16 and transitions to a constant diameter that is substantially the same width as the flange. An annular mandrel 18 is shown coaxially projecting from the end of the casing box 16 distal from the casing string 14. The mandrel 18 slidingly inserts within an annular body 20 on an end opposite the casing box 16. A flange 22 is shown projecting radially outward from the mandrel 18 and coaxially set within an annular groove 24 formed in an inner surface of the body 20. The width of the groove 24 is greater than the thickness of the flange 22 thereby allowing axial movement of the flange 22 within the groove 24.

An aperture 26 is formed through the side wall of the mandrel 18 at an axial location between the flange 22 and lower terminal end of the mandrel 18. Optionally, as shown in the embodiment of FIG. 1A, the mandrel 18 can include multiple apertures 26. Adjacent the aperture 26 is a radially extending port 27 projecting through the wall of the body 20. The port 27 may shape like an elongated narrow window coaxially set within the body 20 with its axial length substantially longer than the diameter of the aperture 26. The aperture 26 provides fluid communication through the side wall of the mandrel 18 and the port 27 correspondingly provides fluid communication through the side wall of the body 20. Further optionally, the body 20 may include multiple ports 27 that in one example correspond to each of the multiple apertures 26. An optional guide 28 is shown on an inner surface of the mandrel 18 located adjacent the mandrel 18 lower end. The guide 28 is made up of a raised portion from the mandrel 18 that projects radially inwards towards an axis $A_X$ of the cementing tool 10.

Still referring to FIG. 1A, a sleeve 30 is shown coaxially set within the cementing tool 10, and more specifically within the body 20 proximate the lower terminal end of the mandrel 18. Sleeve 30 is a generally annular member with its inner radius gradually decreasing from a transition point away from the upper end of the sleeve 30. The decreasing radius within the sleeve 30 defines a shoulder 32 having a frusto-conical configuration. Past the shoulder 32 the radius of the sleeve 30 remains substantially constant along the remaining portion of the sleeve 30. In the configuration of FIG. 1A, the sleeve 30 is held in place by a shear pin 34 shown projecting within the body 20 and outer surface of the sleeve 30.

Further illustrated in FIG. 1A is a flow line 36 that is formed through the wall of the body 20. One end of the flow line 36 intersects with an annularly shaped channel 38 formed into the inner surface of the tool 20 and adjacent the upper portion of the sleeve 30. An optional check valve 40 is provided within the flow line 36 for preventing flow back towards the channel 38. A packer element 42 circumscribes the body 20 in the region having the sleeve 30 and flow line 36. The packer 42 in one example can be an inflatable bladder and made from an elastomer or elastomer-type material. On the outer surface of the tool 20 are anchoring members 44 that can project radially outward from the body 20 for anchoring the cementing tool 10 within a wellbore.

Figure 1B:
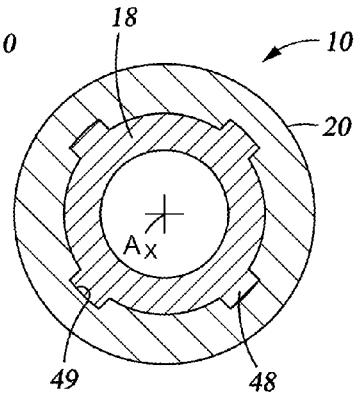
FIGS. 1B and 1C are axial sectional views of the embodiment of the tool in FIG. 1A.

Referring now to FIG. 1B, an axial sectional view of the cementing tool 10 of FIG. 1A is shown along lines 1B-1B. As shown in FIG. 1B, the mandrel 18 is provided with splines 48 that run axially along the outer surface of the mandrel 18 and are received within grooves 49 on the inner surface of the body 20. The optional splines 48 and grooves 49 provide an anti-rotation feature so that when in use the cementing tool 10 can transmit torque values that would otherwise be unobtainable.

Figure 1C:
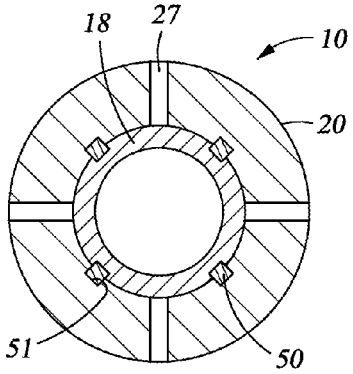

In FIG. 1C, which is an axial sectional view of the cementing tool 10 of FIG. 1A and taken along lines 1C-1C, a series of keys 50 are shown provided in recesses 51 respectively formed in the outer and inner radial surfaces of the mandrel 18 and body 20. As will be described in more detail below, use of the keys 50 enables strategic axial positioning of the mandrel 18 within the body 20 for alignment of the apertures 26 and ports 27.

Figure 2:
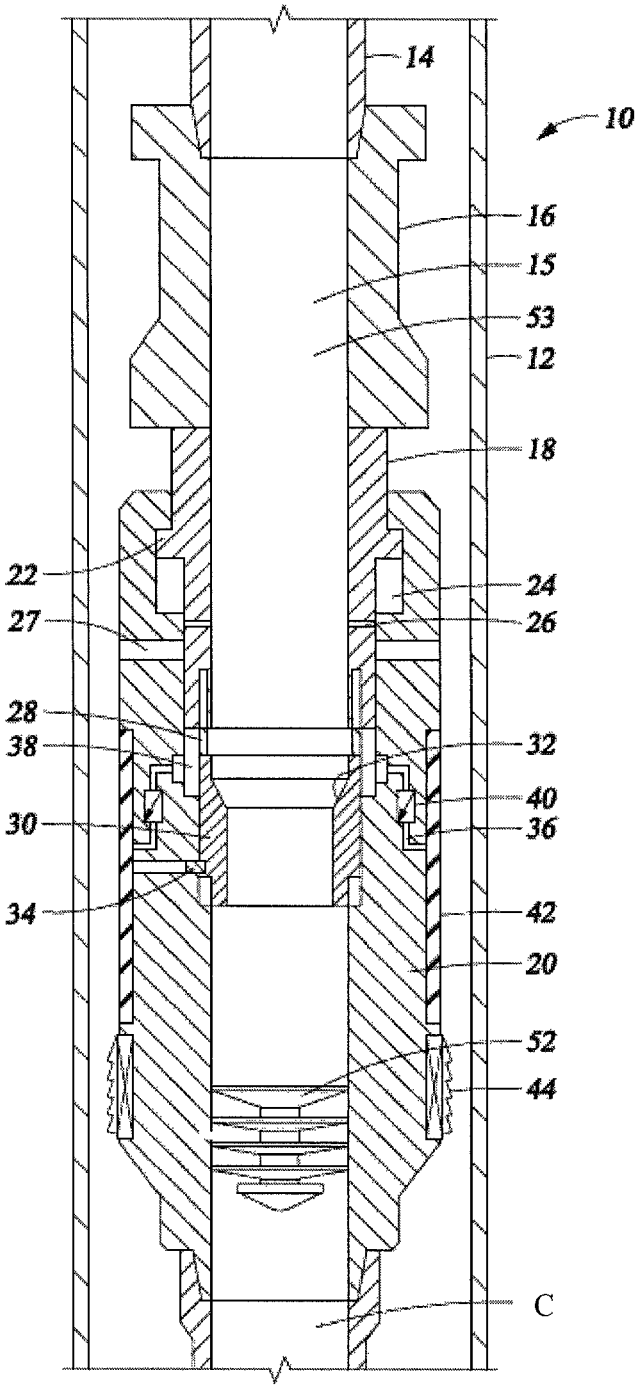
FIG. 2 is a side sectional view of the tool of FIG. 1 with a wiper plug being pushed through the tool bore.

Shown in FIG. 2 is an example of the tool 10 of FIG. 1A during a portion of a cementing operation. In this example, cement C for cementing a casing within the wellbore has been injected into the bore 15; a wiper plug 52 forced in the bore 15 above the cement C is shown pushing the cement C downward through the bore 15. Fluid 53 on the upper surface of the wiper plug 52 is pressurized or pumped into the bore 15 that motivates the wiper plug 52 and cement C further downward within the cementing tool 10 and casing string 14 for pushing it into the annulus (not shown) on the outer surface of the casing string 14.

Figure 3:
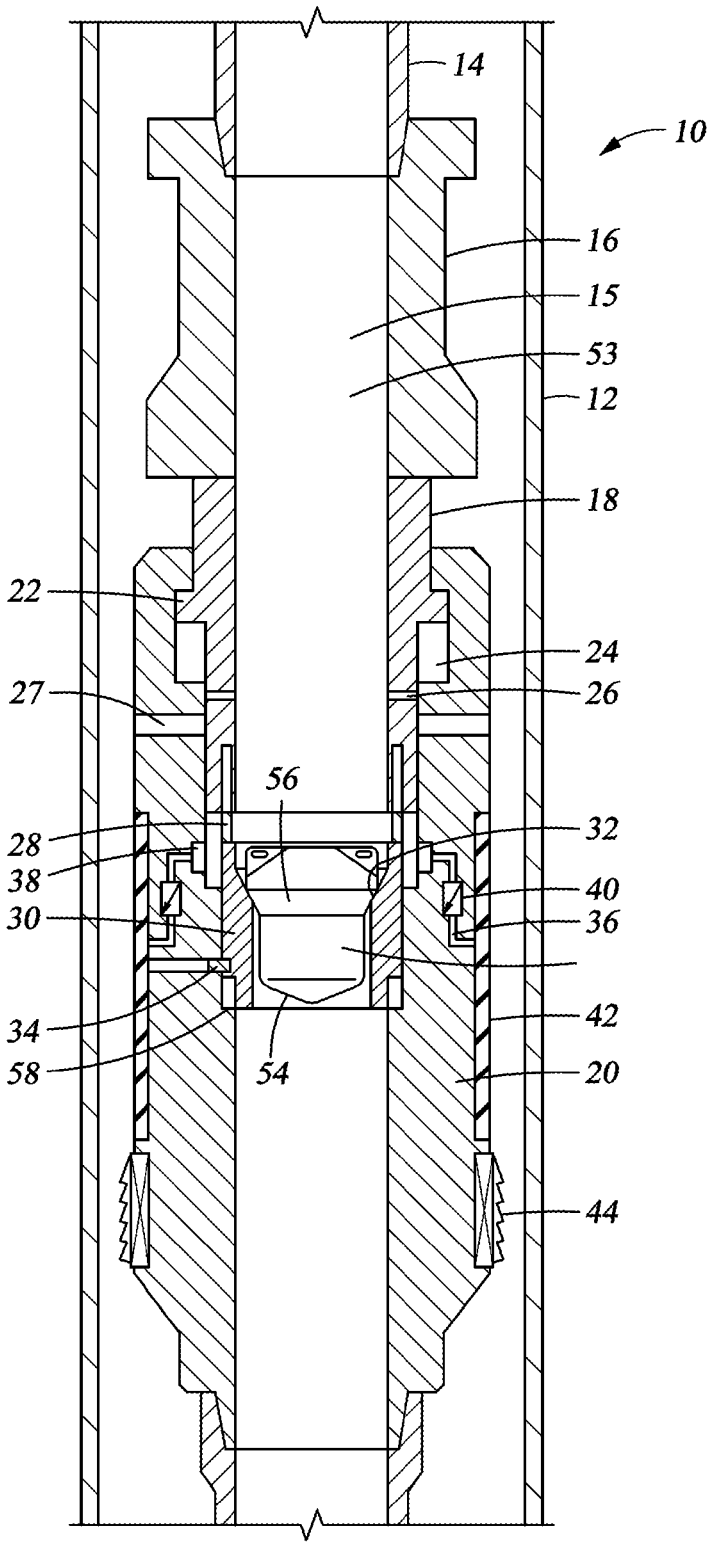
FIG. 3 is a side sectional view of the tool of FIG. 1 shown having an actuation plug landing therein.

Referring now to FIG. 3, a subsequent stage of cementing is illustrated wherein the pressurized fluid 53 fills the entire bore 15 after the wiper plug 52 (FIG. 2) has been pushed to its terminal location. An actuating plug 54 has been inserted into the bore 15 and is shown landing within the sleeve 30 by free-fall without pumping through the fluid 53. In the embodiment of FIG. 3, the actuating plug 54 is a generally cylindrically shaped member and having a radius that increases at a location proximate the upper portion of the actuating plug 54 to define a ridge 56 that projects radially outward from the upper portion of the actuating plug 54. The lower portion of the plug 54 is shown inserted within the decreased radius portion of the sleeve 30. The respective dimensions of the shoulder 32 and the ridge 56 produce an interference so that the ridge 56 is landed on the shoulder 32. The relative configurations of the ridge 56 and shoulder 32 further form a sealing interface between the actuating plug 54 and sleeve 30; so that by pumping fluid into the bore above the actuating plug 54 the pressure increases on the upper surface of the actuating plug 54. Ultimately, as the pressure differential increases across the actuating plug 54, the resulting increase in downward force on the sleeve 30 eventually exceeds the yield strength of the shear pins 34 and fractures the shear pins 34, to release the sleeve 30 from its anchoring position. The force applied from the actuating plug 54 slides the sleeve 30 downward within the cementing tool 10 and relative to the body 20. The inner radius of the body 20 decreases at a position to define a ledge 58 that forms a lower stop for the sleeve 30. The presence of the ledge 58 thereby prevents uncontrolled downward sliding of the sleeve 30.

Figure 4:
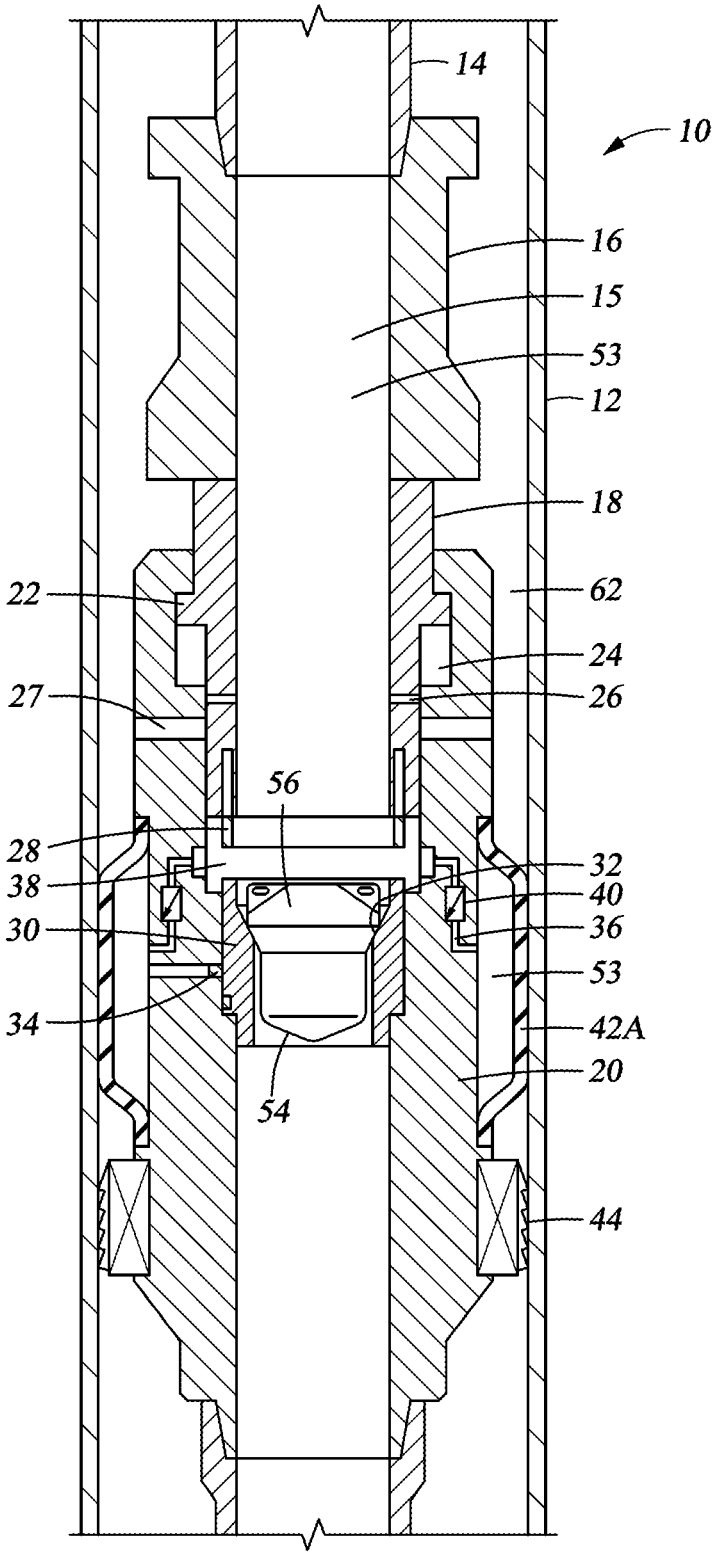
FIG. 4 is a side sectional view of the configuration of FIG. 3 with the plug being pushed downward to actuate a portion of the tool.

In FIG. 4, the downward position of the plug 54 and sleeve 30 shows the channel 38, that had previously been isolated from the bore 15, now in fluid communication with the bore 15. Accordingly, the pressurized fluid 53 and the bore 15 is in fluid communication with the flow line 36 and is shown flowing through the flow line 36 and forming an inflated packer element 42A. The presence of the check valves 40, while permitting flow from the bore 15 into the packer 42A, prevent back flow into the bore 15 thereby preventing deflation of the packer 42A and maintaining a pressure barrier between the tool 10 and casing 12. Also shown in FIG. 4 are the anchors 44 that have been deployed radially outward from the body 20 and into anchoring contact with the casing 12. The anchors 44 may be activated at the same time the packer 42A is inflated.

Figure 5A:
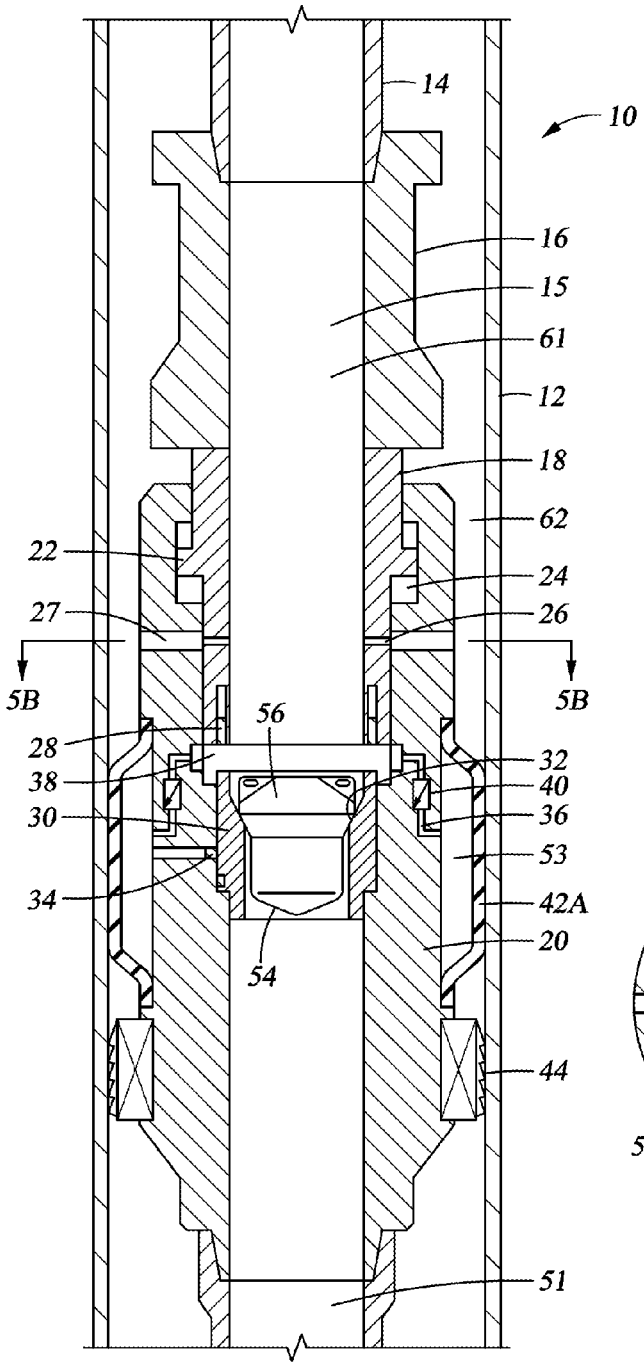
FIG. 5A is a side sectional view of the tool of FIG. 4 and having open side ports.
Figure 5B:
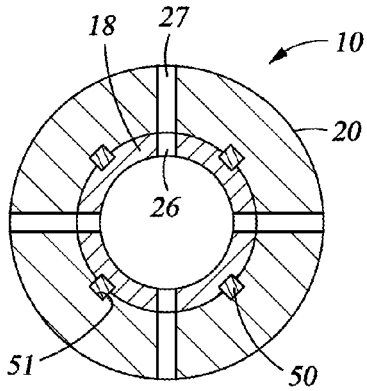
FIG. 5B is an axial sectional view of the tool of FIG. 5A taken along lines 5B-5E.

Cement 61 is shown being directed into an annulus 62 between the cementing tool 10 and casing 12 in the side sectional view of FIG. 5A. In this embodiment, the casing string 14 has been lowered from the surface, while the cementing tool 10 is anchored in place, thereby pushing the mandrel 18 lower within the body 20. The downward movement of the casing string 14 is shown registering the aperture 26 with the port 27 to define a flow path between the bore 15 and annulus 62. As such, flowing cement in this configuration can provide cement within the annulus of the wellbore above the inflated packer 42A. The flange 22 is shown moved axially downward within the groove 24 from its initial position at the upper portion of the groove 24. FIG. 5B, which is an axial sectional view of the tool 10 of FIG. 5A and taken along lines 5B-5B further illustrates the registration of the aperture 26 and port 27. As noted above, the presence of the keys 50 ensure the angular orientation of the mandrel 18 and body 20 are maintained so that axially displacing the mandrel 18 within the body 20 selectively registers the aperture 26 and port 27.

Figure 6:
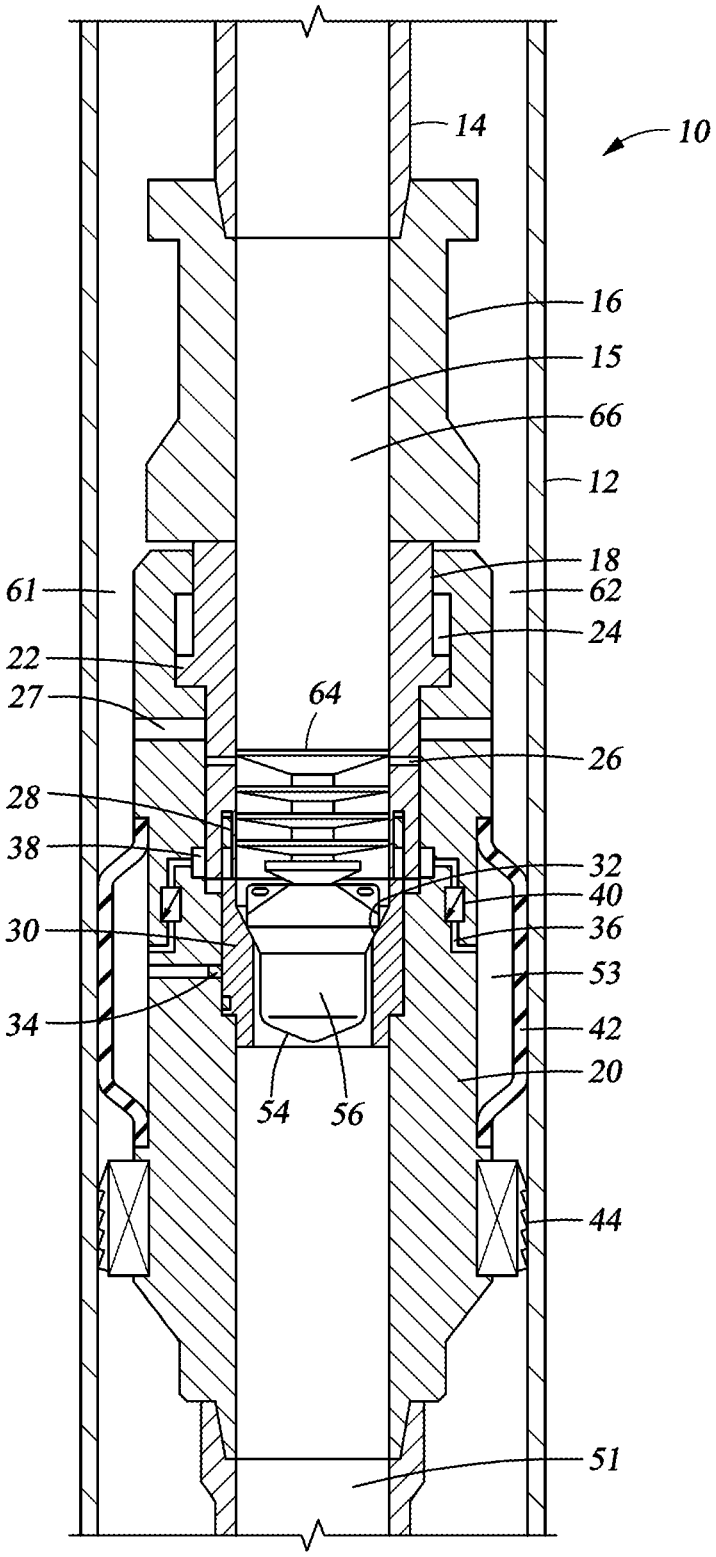
FIG. 6 is a side sectional view of the tool of FIG. 5A with a wiper plug landed on the actuation plug.

Subsequent to the step in FIGS. 5A and 5B, a wiper plug 64 is shown landed on the upper surface of the actuating plug 54 in the sectional view of FIG. 6. The wiper plug 64, similar to the wiper plug 52 of FIG. 2, is used to urge the cement 61 from within the bore 15 and into the annulus 62. Further illustrated in the embodiment of FIG. 6, the casing string 14 is moved downward further so that the aperture 26 is below the port 27 and in an unregistered configuration, thereby sealing the bore 15 from the annulus 62. A pressurized fluid 66 is shown within the bore 15 and above the wiper plug 64 to provide a motive force for moving the plug 64 within the bore 15. In one example embodiment, the casing string 14 may include multiple cementing tools 10 within the string and cement may be deployed in the stages between each subsequent cementing tool 10. In an embodiment, the cementing tool 10 located deeper in a well has a smaller actuating plug 54 with a corresponding smaller sleeve 30 and shoulder 32.

Figure 7:
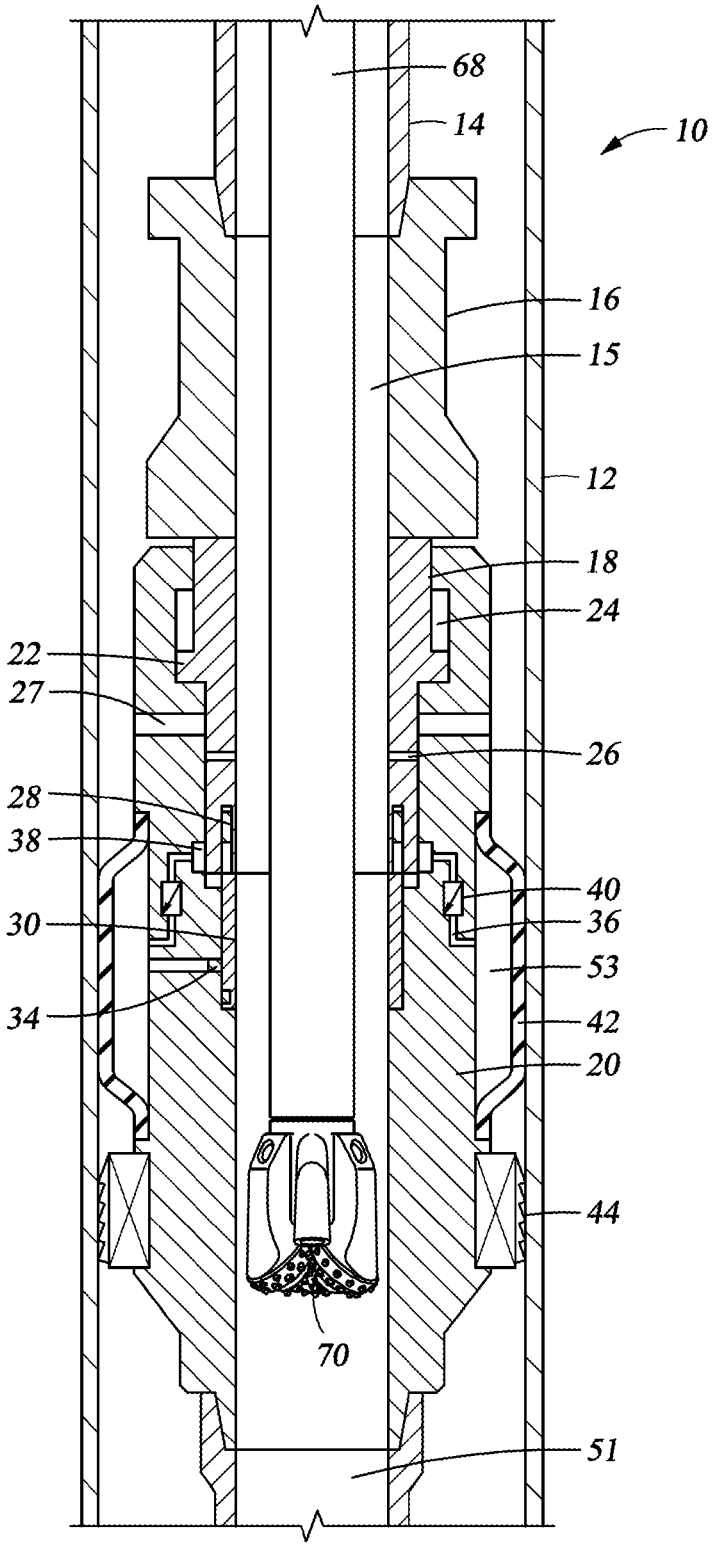
FIG. 7 is a side sectional view of the tool of FIG. 6 and having the plugs being removed by a drill.

Referring now to FIG. 7, a side sectional view of the cementing tool 10 is shown after completion of cementing the various stages. In this embodiment a drill string 68 with drill bit 70 is shown inserted through the bore 15 for drilling through the wiper plug 64 and shifting (actuating) plug 54 that may remain within the bore of the casing string 14 and tools. Also illustrated in the example of FIG. 7, the inwardly projecting portion of the sleeve has been removed to leave a sleeve 30A with an inner circumference substantially the same as the remaining portions of the bore 15. In this example, the further downward movement of the mandrel 18 within the body 20 positions a lower end of the mandrel 18 in a space between the channel 38 and flow line 36, thereby sealing the packer 42A from the bore 15.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A method of cementing a stage of a wellbore comprising:

(a) providing a downhole tool having an annular casing box section with an end adapted for connection to a casing string, an annular mandrel section having an end coaxially coupled to an end of the casing box section distal from the end adapted for connection to a casing string, a tubular body slidingly coupled with an end of the mandrel section distal from the end coupled to the casing box section, an aperture formed radially through a side wall of the mandrel section, and a port formed radially through a side wall of the tubular body;

(b) placing the tool integral with a casing string;

(c) inserting the casing string in the wellbore;

(d) flowing cement within a bore that extends through the casing string and tool;

(e) obstructing the bore within the tool;

(f) registering the aperture and port by lowering the casing string; and (g) directing cement through the registered port and aperture.

2. The method of claim 1, further comprising unregistering the port and aperture by further lowering the casing string.

3. The method of claim 1, wherein step (e) occurs after step (d).

4. The method of claim 1, wherein the tool further comprises a bladder that circumscribes the body, the method further comprising forming a pressure seal between the tool and casing by inflating the bladder so that the bladder fills a portion of an annular space between the tool and casing and pressure testing the pressure seal.

5. The method of claim 4, wherein the tool includes a flow path between the bore and bladder and through the body, a sleeve slidable along an inner wall of the body, and wherein the step of inflating the bladder comprises sliding the sleeve from a position adjacent the flow path and blocking fluid communication between the bore and the bladder to a position away from the flow path so that the bore is in fluid communication with the bladder and fluid flows from the bore, through the flow path, and into the bladder.

6. The method of claim 5, wherein the sleeve includes a shoulder that depends radially inward and is actuated by landing a plug onto the shoulder and pressurizing the bore above the plug to slide the sleeve to the position away from the flow path.

7. The method of claim 6, further comprising lowering the casing string to move the mandrel adjacent the flow path and seal the bore from the bladder.

8. A method of cementing a stage of a wellbore comprising:

(a) providing in a casing string in the wellbore a downhole tool having an axial bore, an annular casing box section with an end adapted for connection to a casing string, an annular mandrel section having an end coaxially coupled to an end of the casing box section distal from the end adapted for connection to a casing string, a tubular body slidingly coupled with an end of the mandrel section distal from the end coupled to the casing box section, a bladder circumscribing the body, and a flow line through the body between the bladder and the bore;

(b) cementing a portion of the casing string below the tool by flowing cement through the bore and forcing the cement out a lower end of the casing string and into an annulus between the casing string and wellbore;

(c) inflating the bladder by directing pressurized fluid from the bore through the flow line and to an inner surface of the bladder thereby forming a pressure seal between the tool and an outer casing string; and (d) pressure testing the pressure seal.

9. The method of claim 8, wherein step (c) includes sealing the bore below where the flow line intersects the bore.

10. The method of claim 8, wherein the tool further comprises a sleeve coaxially set in the bore and providing a flow barrier between the bore and the flow line, the method further comprising forming a seal in the bore by landing a plug in the sleeve, urging the sleeve downward by pressurizing the bore above the plug to remove the flow barrier between the bore and the flow line so that fluid in the bore flows into the flow line where the fluid is directed into the bladder to inflate the bladder.

11. The method of claim 10, further comprising sliding the mandrel downward to a position between the bore and the flow line to form a flow barrier between the bore and the flow line.

12. The method of claim 8, wherein the tool further includes an aperture formed radially through a side wall of the mandrel section and a port formed radially through a side wall of the tubular body, the method further comprising lowering the mandrel within the body to register the port and aperture, flowing cement from the bore, through the aperture and the port.

13. A downhole tool for use in a wellbore cementing staging operation, the tool comprising:

an annular casing box section having an end adapted for connection to a casing string;

an annular mandrel section having an end coaxially coupled to an end of the casing box section distal from the end adapted for connection to a casing string;

a tubular body slidingly coupled with an end of the mandrel section distal from the end coupled to the casing box section;

apertures formed radially through a side wall of the mandrel section;

ports formed radially through a side wall of the tubular body, so that when the casing box is connected to a casing string inserted in a wellbore and the casing string is lowered within the wellbore, the mandrel section is inserted within the body from a first position with the apertures unregistered with the ports, to a second position with the apertures registered with the ports, and to a third position with the apertures unregistered with the ports, where the second position is between the first and third positions; and an annular sliding sleeve coaxially within a bore axially formed through the tool and selectively slidable from a first position in the body to a second position in the body.

14. The downhole tool of claim 13, further comprising a packer circumscribing a portion of the body and a flow line extending through a side wall of the body between a location adjacent the sliding sleeve when the sliding sleeve is in the first position and an inner surface of the packer, so that when the sleeve slides into the second position, the flow line is exposed to the bore thereby providing fluid communication between the bore an inner surface of the packer.

15. The downhole tool of claim 14, further comprising check valves in the flow line.

16. The downhole tool of claim 13, further comprising anchors.

17. The downhole tool of claim 13, further comprising a flange on the end of the mandrel inserted within the body that reciprocates within an annular space in the body that is coaxial with the flange.

18. The downhole tool of claim 13, further comprising a casing pin on the end of the tool distal from the casing box section.

* * * * *